US009611714B2

(12) United States Patent
Donald et al.

(10) Patent No.: US 9,611,714 B2
(45) Date of Patent: Apr. 4, 2017

(54) OILFIELD APPARATUS AND METHODS OF USE

(71) Applicants: Ian Donald, Monymusk (GB); John Reid, Inchture (GB)

(72) Inventors: Ian Donald, Monymusk (GB); John Reid, Inchture (GB)

( * ) Notice: Subject to any disclaimer, the term of this patent is extended or adjusted under 35 U.S.C. 154(b) by 0 days.

(21) Appl. No.: 14/396,660

(22) PCT Filed: Apr. 26, 2013

(86) PCT No.: PCT/GB2013/051059

§ 371 (c)(1),
(2) Date: Oct. 23, 2014

(87) PCT Pub. No.: WO2013/160687

PCT Pub. Date: Oct. 31, 2013

(65) Prior Publication Data

US 2015/0075805 A1 Mar. 19, 2015

Related U.S. Application Data

(60) Provisional application No. 61/639,020, filed on Apr. 26, 2012.

(51) Int. Cl.
*E21B 33/076* (2006.01)
*E21B 49/08* (2006.01)
(Continued)

(52) U.S. Cl.
CPC ..... *E21B 33/076* (2013.01); *E21B 33/035* (2013.01); *E21B 33/038* (2013.01); *E21B 49/084* (2013.01); *E21B 49/086* (2013.01)

(58) Field of Classification Search
CPC .... E21B 33/076; E21B 49/086; E21B 33/035; E21B 33/038; E21B 49/084; E21B 49/001
See application file for complete search history.

(56) References Cited

U.S. PATENT DOCUMENTS 3,973,587 A 8/1976 Cochran
4,047,695 A 9/1977 Cleveland et al.
(Continued)

FOREIGN PATENT DOCUMENTS

GB 2377425 A 1/2003
WO 00/70185 A1 11/2000
(Continued)

OTHER PUBLICATIONS

Office Action dated Feb. 9, 2015 from U.S. Appl. No. 14/396,658, filed Oct. 23, 2014.
(Continued)

*Primary Examiner* — James G Sayre
(74) *Attorney, Agent, or Firm* — Sunstone IP

(57) ABSTRACT

The invention in one of its aspects provides a connection apparatus for a subsea hydraulic circuit and method of use in a sampling application. The apparatus comprises a longitudinal body configured to be removably docked with a subsea hydraulic circuit receptacle. The body comprises a plurality of radial ports axially displaced along the body, and an axial bore accommodating a spool having at least one fluid barrier. The spool and fluid barrier are actuable to be axially moved in the bore to control axial flow paths along the bore between the plurality of radial ports. The apparatus may be configured as a sampling hot stab in an application to sampling a production fluid from a subsea hydrocarbon production system.

32 Claims, 7 Drawing Sheets

(51) Int. Cl.
*E21B 33/035* (2006.01)
*E21B 33/038* (2006.01)

(56) References Cited

U.S. PATENT DOCUMENTS

| | | | |
|---|---|---|---|
| 4,540,022 | A | 9/1985 | Cove |
| 4,748,011 | A | 5/1988 | Baize |
| 6,460,620 | B1 | 10/2002 | LaFleur |
| 6,460,621 | B2 | 10/2002 | Fenton et al. |
| 6,481,504 | B1 | 11/2002 | Gatherar |
| 6,536,528 | B1 | 3/2003 | Amin et al. |
| 6,698,520 | B2 | 3/2004 | Fenton et al. |
| 6,776,188 | B1 | 8/2004 | Rajewski |
| 6,973,936 | B2 | 12/2005 | Watson |
| 7,040,408 | B2 | 5/2006 | Sundararajan et al. |
| 7,219,740 | B2 | 5/2007 | Saucier |
| 7,757,772 | B2 * | 7/2010 | Donohue ..... E21B 33/0355 166/338 |
| 8,181,705 | B2 | 5/2012 | Tveiten et al. |
| 8,186,440 | B2 | 5/2012 | Tveiten et al. |
| 8,297,360 | B2 | 10/2012 | Donald et al. |
| 8,327,875 | B2 | 12/2012 | Gract et al. |
| 8,550,170 | B2 | 10/2013 | McHugh et al. |
| 8,931,561 | B2 | 1/2015 | Baker et al. |
| 9,169,709 | B2 | 10/2015 | Vincent et al. |
| 9,365,271 | B2 | 6/2016 | Minnock et al. |
| 9,441,452 | B2 | 9/2016 | Donald |
| 2003/0056955 | A1 | 3/2003 | Watson |
| 2006/0108120 | A1 | 5/2006 | Saucier |
| 2010/0059221 | A1 | 3/2010 | Vannuffelen et al. |
| 2011/0061854 | A1 | 3/2011 | Davies |
| 2011/0192609 | A1 | 8/2011 | Tan et al. |
| 2012/0006556 | A1 | 1/2012 | McHugh et al. |
| 2012/0111571 | A1 | 5/2012 | Eriksen |
| 2013/0000918 | A1 | 1/2013 | Voss |
| 2015/0027730 | A1 | 1/2015 | Hall et al. |

FOREIGN PATENT DOCUMENTS

| | | | |
|---|---|---|---|
| WO | 2005/047646 | A1 | 5/2005 |
| WO | 2005/083228 | A1 | 9/2005 |
| WO | 2007/016678 | A2 | 2/2007 |
| WO | 2012107727 | A2 | 8/2012 |
| WO | 2013/121212 | A2 | 8/2013 |
| WO | 2013126592 | A2 | 8/2013 |

OTHER PUBLICATIONS

International Search Report dated Apr. 7, 2014 from International Patent Application No. PCT/2013/051058 filed Apr. 26, 2013.
International Preliminary Report on Patentability dated Oct. 28, 2014 from International Patent Application No. PCT/2013/051058 filed Apr. 26, 2013.
Office Action dated Sep. 29, 2015 from U.S. Appl. No. 14/396,658, filed Oct. 23, 2014.
Office Action dated Aug. 6, 2015 from U.S. Appl. No. 14/379,277, filed Aug. 15, 2014.
Office Action dated Feb. 29, 2016 from U.S. Appl. No. 14/379,277, filed Aug. 15, 2014.
Notice of Allowance dated Apr. 6, 2016 from U.S. Appl. No. 14/396,658, filed Oct. 23, 2014.
Ian Donald et al: "Using MARS (Multiple Application Re-Injection Sysem) Technology for Improving Oil Recovery and Reducing Production Risk," Proceedings of International Oil and Gas Conference and Exhibition in China, Jun. 8, 2010 (Jun. 8, 2010), XP055063295, DOI: 10.2118/132274-MS, ISBN: 978-1-55-563295-3.
International Search Report and Written Opinion dated Jul. 19, 2016 from International Patent Application No. PCT/GB2015/054021 filed Dec. 15, 2015.
Office Action dated Oct. 12, 2016 from U.S. Appl. No. 15/260,906, filed Sep. 9, 2016.
Office Action dated Jan. 18, 2017 from U.S. Appl. No. 15/121,981 filed, Aug. 26, 2016.

* cited by examiner

OILFIELD APPARATUS AND METHODS OF USE

The present invention relates to oilfield apparatus and methods of use, and in particular to a sampling apparatus (such as a sampling chamber, a sampling test circuit, sampling tools), and methods of use for fluid intervention and sampling in oil and gas production or injection systems. The invention has particular application to subsea oil and gas operations, and aspects of the invention relate specifically to methods and apparatus for combined fluid injection and sampling applications.

BACKGROUND TO THE INVENTION

In the field of oil and gas exploration and production, it is common to install an assembly of valves, spools and fittings on a wellhead for the control of fluid flow into or out of the well. Such flow systems typically include a Christmas tree, which is a type of fluid manifold used in the oil and gas industry in surface well and subsea well configurations. A Christmas tree has a wide range of functions, including chemical injection, well intervention, pressure relief and well monitoring. Christmas trees are also used to control the injection of water or other fluids into a wellbore to control production from the reservoir.

There are a number of reasons why it is desirable to access a flow system in an oil and gas production system (generally referred to as an "intervention"). In the context of this specification, the term "fluid intervention" is used to encapsulate any method which accesses a flow line, manifold or tubing in an oil and gas production, injection or transportation system. This includes (but is not limited to) accessing a flow system for fluid sampling, fluid diversion, fluid recovery, fluid injection, fluid circulation, fluid measurement and/or fluid metering. This can be distinguished from full well intervention operations, which generally provide full (or near full) access to the wellbore. Full well intervention processes and applications are often technically complex, time-consuming and have a different cost profile to fluid intervention operations. It will be apparent from the following description that the present invention has application to full well intervention operations. However, it is an advantage of the invention that full well intervention may be avoided, and therefore preferred embodiments of the invention provide methods and apparatus for fluid intervention which do not require full well intervention processes.

International patent application numbers WO00/70185, WO2005/047646 and WO2005/083228 describe a number of configurations for accessing a hydrocarbon well via a choke body on a Christmas tree. Although a choke body provides a convenient access point in some applications, the methods of WO00/70185, WO2005/047646, and WO2005/083228 do have a number of disadvantages. Firstly, a Christmas tree is a complex and carefully-designed piece of equipment. The choke performs an important function in production or injection processes, and its location on the Christmas tree is selected to be optimal for its intended operation. Where the choke is removed from the choke body, as proposed in the prior art, the choke must be repositioned elsewhere in the flow system to maintain its functionality. This compromises the original design of the Christmas tree, as it requires the choke to be located in a sub-optimal position.

Secondly, a choke body on a Christmas tree is typically not designed to support dynamic and/or static loads imparted by intervention equipment and processes. Typical loads on a choke body in normal use would be of the order of 0.5 to 1 tonnes, and the Christmas tree is engineered with this in mind. In comparison, a typical flow metering system as contemplated in the prior art may have a weight of the order of 2 to 3 tonnes, and the dynamic loads may be more than three times that value. Mounting a metering system (or other fluid intervention equipment) on the choke body therefore exposes that part of the Christmas tree to loads in excess of those that it is designed to withstand, creating a risk of damage to the structure. This problem may be exacerbated in deepwater applications, where even greater loads may be experienced due to thicker and/or stiffer components used in the subsea infrastructure.

In addition to the load restrictions identified above, positioning the flow intervention equipment on the choke body may limit the access available to large items of process equipment and/or access of divers or remotely operated vehicles (ROVs) to the process equipment or other parts of the tree.

Furthermore, modifying the Christmas tree so that the chokes are in non-standard positions is generally undesirable. It is preferable for divers and/or ROV operators to be completely familiar with the configuration of components on the Christmas tree, and deviations in the location of critical components are preferably avoided.

Another drawback of the prior art proposals is that not all Christmas trees have chokes integrated with the system; approaches which rely on Christmas tree choke body access to the flow system are not applicable to these types of tree.

It is amongst the objects of the invention to provide a method and apparatus for accessing a flow system in an oil and gas production system, which addresses one or more drawbacks or disadvantages of the prior art. In particular, it is amongst the objects of the invention to provide a method and apparatus for fluid intervention in an oil and gas production system, which addresses one or more drawbacks of the prior art. An object of the invention is to provide a flexible method and apparatus suitable for use with and/or retrofitting to industry standard or proprietary oil and gas production manifolds, including Christmas trees.

It is an aim of at least one aspect or embodiment of the invention to provide an apparatus which may be configured for use in both a subsea fluid injection operation and a production fluid sampling operation and a method of use.

An aim of at least one aspect of the invention is to provide an improved sampling apparatus for oil and gas operations and methods of use. Other aims and objects of the invention include providing an improved sampling chamber, a sampling test circuit, sampling tools, and/or methods for fluid intervention which are improved with respect to sampling apparatus and method of the prior art. A further aim of at least one aspect of the invention is to provide a sampling apparatus and method of use which facilitates the use of novel flow system access methods and fluid intervention operations.

Further objects and aims of the invention will become apparent from the following description.

SUMMARY OF THE INVENTION

According to a first aspect of the invention there is provided a sampling apparatus for a hydrocarbon production system, the sampling apparatus comprising:

a sampling chamber;

a fluid inlet and a fluid outlet to the sampling chamber, the fluid inlet and fluid outlet configured to be in communication with a production fluid flowing in a production flow bore; and a sampling port in fluid communication with the sampling chamber;

wherein the sampling apparatus comprises a formation configured to be exposed to a production fluid flowing in the production bore and create a pressure differential between the fluid inlet and fluid outlet which drives production fluid from the production bore into the sampling chamber via the fluid inlet.

Preferably the formation is configured to create a Venturi effect which reduces the pressure in the production bore in an area closer to the fluid outlet than the fluid inlet. The formation may reduce the pressure in the production bore adjacent or substantially adjacent the fluid outlet.

The formation may comprise a flow restriction in the production bore. The flow restriction may be arranged such that the narrowest point of the production bore (at least in a locality of the sampling apparatus) is adjacent or substantially adjacent to the fluid outlet.

Preferably the apparatus is configured to circulate fluid through the sampling chamber via the fluid inlet and fluid outlet.

An opening to the fluid inlet may at least partially be oriented to face a prevailing flow direction of production fluid in the production bore. This may assist in directing flow into the fluid inlet. An opening to the fluid outlet may at least partially be oriented perpendicular to a prevailing flow direction of production fluid in the production bore. This may assist in exposing the fluid outlet to an area of reduced local pressure, and enhance circulation of fluid through the sampling apparatus.

The sampling chamber may be disposed radially of the production bore, and may be located in a side bore formed to the production bore.

At least a part of the sampling chamber may be located above the production bore, and in one embodiment, the sampling chamber is located entirely above the production bore. In this configuration, the production fluid is drawn into the sampling chamber against the effect of gravity.

At least a part of the sampling chamber may be located below the production bore, and in one embodiment, the sampling chamber is located entirely below the production bore. In this configuration, the production fluid is drawn into the sampling chamber with assistance from the effect of gravity.

The sampling chamber may comprise one or more baffles. The sampling port may comprise a stem which extends into the sampling chamber. An opening to the stem may be located in a lower portion of the sampling chamber. Thus the opening to the stem may be configured to preferentially withdraw liquid phase fluids from the sampling chamber.

The formation may be disposed asymmetrically in the production flow bore (i.e. on one side of the production bore).

The hydrocarbon production system may be a subsea hydrocarbon production, and the production flow bore may be a subsea flow line from a subsea well operating in production mode.

The sampling apparatus may be configured to collect a sample of a production fluid flowing in a production flow bore via the fluid inlet when in a sampling mode; and may be configured to provide an injection flow path for an injection fluid from an injection fluid conduit to the production flow bore when operating in an injection mode.

According to a second aspect of the invention there is provided a hydrocarbon production system comprising:

a production flow bore;

a sampling apparatus associated with the production flow bore, the sampling apparatus having a sampling chamber, a fluid inlet and a fluid outlet to the sampling chamber in communication with a production fluid flowing in a production flow bore; and a sampling port in fluid communication with the sampling chamber;

wherein the production flow bore comprises a formation which when exposed to a production fluid flowing in the production bore which creates a pressure differential between the fluid inlet and fluid outlet which drives production fluid from the production bore into the sampling chamber via the fluid inlet.

The sampling apparatus may have a first mode of operation in which a sample of a production fluid flowing in a production flow bore is collected via the fluid inlet; and may have a second mode of operation in which the sampling apparatus provides an injection flow path for an injection fluid from an injection fluid conduit to the production flow bore.

Embodiments of the second aspect of the invention may include one or more features of the first aspect of the invention or its embodiments, or vice versa.

According to a third aspect of the invention there is provided a method of collecting a sample of fluid from a hydrocarbon production system, the method comprising:

providing a sampling apparatus associated with a production flow bore, the sampling apparatus having a sampling chamber, a fluid inlet and a fluid outlet to the sampling chamber in communication with a production fluid flowing in a production flow bore; and a sampling port in fluid communication with the sampling chamber;

exposing the flow of production fluid to a formation to create a pressure differential between the fluid inlet and fluid outlet which drives production fluid from the production bore into the sampling chamber via the fluid inlet.

The method may comprise, in an injection mode of operation, passing an injection fluid from an injection fluid conduit through a flow path in the sampling apparatus to the production flow bore. The method may comprise, in a sampling mode of operation, collecting a sample of a production fluid flowing in a production flow bore via the fluid inlet.

Embodiments of the third aspect of the invention may include one or more features of the first or second aspects of the invention or their embodiments, or vice versa.

According to a fourth aspect of the invention there is provided a sampling apparatus for a hydrocarbon production system, the sampling apparatus comprising:

a sampling chamber;

a fluid inlet and a fluid outlet to the sampling chamber, the fluid inlet and fluid outlet configured to be in communication with a production fluid flowing in a production flow bore;

wherein the sampling apparatus is configured to collecting a sample of a production fluid flowing in a production flow bore via the fluid inlet when in a sampling mode; and is configured to provides an injection flow path for an injection fluid from an injection fluid conduit to the production flow bore when operating in an injection mode.

The flow path may pass through the sampling chamber or a part thereof. The sampling apparatus may be configured to be disposed in an injection bore of the hydrocarbon production system. Preferably the flow path is an alternate flow path to those of the sampling conduits, including the paths created fluid inlet, fluid outlet and/or the sampling port (i.e. it is not necessary for the injection fluid to pass through the fluid inlet, fluid outlet or sampling ports.

The sampling apparatus may comprise a formation configured to be exposed to a production fluid flowing in the production bore and create a pressure differential between the fluid inlet and fluid outlet which drives production fluid from the production bore into the sampling chamber via the fluid inlet.

Embodiments of the fourth aspect of the invention may include one or more features of the first to third aspects of the invention or their embodiments, or vice versa.

According to a fifth aspect of the invention there is provided a hydrocarbon production system comprising:

a production flow bore;

a sampling apparatus associated with the production flow bore, the sampling apparatus having a sampling chamber for collecting a sample of a production fluid flowing in a production flow bore;

wherein the sampling apparatus has a first mode of operation in which a sample of a production fluid flowing in a production flow bore is collected via the fluid inlet;

and wherein the sampling apparatus has a second mode of operation in which the sampling apparatus provides an injection flow path for an injection fluid from an injection fluid conduit to the production flow bore.

The production flow bore may comprise a formation which when exposed to a production fluid flowing in the production bore which creates a pressure differential between the fluid inlet and fluid outlet which drives production fluid from the production bore into the sampling chamber via the fluid inlet.

The sampling apparatus may comprise ports which define an injection flow path through the sampling apparatus in an injection mode.

The sampling apparatus may be configured to have a first condition in sampling mode. The injection flow path may be closed in the first condition. The sampling apparatus may be configured to have a second condition in an injection mode, in which the injection flow path is open.

The sampling apparatus may be configured to be moved from a first condition to a second condition by injection fluid pressure.

The hydrocarbon production system may comprise an isolation valve operatively associated with the sampling apparatus. In the first condition, the isolation valve may be closed and may isolate the sampling chamber from injection fluid.

Embodiments of the fifth aspect of the invention may include one or more features of the first to fourth aspects of the invention or their embodiments, or vice versa.

According to a sixth aspect of the invention there is provided a method of collecting a sample of fluid from a hydrocarbon production system, the method comprising: providing a sampling apparatus associated with a production flow bore, the sampling apparatus having a sampling chamber, a fluid inlet and a fluid outlet to the sampling chamber in communication with a production fluid flowing in a production flow bore; in an injection mode of operation, passing an injection fluid from an injection fluid conduit through a flow path in the sampling apparatus to the production flow bore.

The method may comprise, in a sampling mode of operation, collecting a sample of a production fluid flowing in a production flow bore via the fluid inlet.

The method may comprise exposing the flow of production fluid to a formation to create a pressure differential between the fluid inlet and fluid outlet which drives production fluid from the production bore into the sampling chamber via the fluid inlet.

Embodiments of the sixth aspect of the invention may include one or more features of the first to fifth aspects of the invention or their embodiments, or vice versa.

According to a seventh aspect of the invention there is provided a method of injecting an injection fluid into a hydrocarbon production system using the apparatus or systems of any previous aspect of the invention.

Embodiments of the seventh aspect of the invention may include one or more features of the first to sixth aspects of the invention or their embodiments, or vice versa.

According to an eighth aspect of the invention there is provided a connection apparatus for a subsea hydraulic circuit, the connection apparatus comprising:

a longitudinal body configured to be removably docked with a subsea hydraulic circuit receptacle, the longitudinal body comprising a plurality of radial ports axially displaced along the body;

wherein the body comprises an axial bore accommodating a spool having at least one fluid barrier;

and wherein the spool and fluid barrier are actuable to be axially moved in the bore to control axial flow paths along the bore between the plurality of radial ports.

The connection apparatus is preferably a hot stab hydraulic connection interface, configured to be received in a standard hot stab receptacle.

The fluid barrier may be an annular fluid barrier to seal an annulus between the spool and the bore. The apparatus may comprise at least three radial ports, and the spool and fluid barrier may be actuable to be axially moved from a first position in which a flow path between a first port and a second port is open, and a second position in which a flow path between the second port and a third port is open. In the first position a flow path from the third port to the first or second ports is preferably closed. In the second position, a flow path from the first port to the second or third ports is preferably closed.

Embodiments of the eighth aspect of the invention may include one or more features of the first to seventh aspects of the invention or their embodiments, or vice versa.

According to a ninth aspect of the invention there is provided a hot stab apparatus for a remotely operated vehicle, the hot stab apparatus comprising:

a longitudinal body configured to be removably docked with a hot stab receptacle, the longitudinal body comprising a plurality of radial ports axially displaced along the body;

wherein the body comprises an axial bore accommodating a spool having at least one fluid barrier;

and wherein the spool and fluid barrier are actuable to be axially moved in the bore to control axial flow paths along the bore between the plurality of radial ports.

Embodiments of the ninth aspect of the invention may include one or more features of the first to eighth aspects of the invention or their embodiments, or vice versa.

The invention encapsulates methods of use of the apparatus of the eighth and ninth aspects in a hydrocarbon fluid sampling operation.

According to a tenth aspect of the invention there is provided a method of collecting a sample of fluid from a hydrocarbon production system, comprising using the apparatus of the eighth aspect of the invention to deliver a sample of fluid from the hydrocarbon production system to a sample collection vessel.

Embodiments of the tenth aspect of the invention may include one or more features of the first to ninth aspects of the invention or their embodiments, or vice versa.

According to an eleventh aspect of the invention there is provided a method of collecting a sample of fluid from a hydrocarbon production system, the method comprising:

providing a sample collection vessel and a sampling hot stab apparatus in fluid communication with the sample collection vessel;

locating the sampling hot stab apparatus in a receptacle of the hydrocarbon production system, the receptacle being in fluid communication with a production fluid in the hydrocarbon production system;

collecting production fluid in the sample collection vessel via the sampling hot stab apparatus;

flushing the sampling hot stab apparatus prior to removal of the sampling hot stab apparatus from the receptacle.

The method may comprise providing a test hot stab apparatus, and coupling the test hot stab apparatus to the sample collection chamber and/or hydrocarbon production system.

The method may comprise decanting a pre-charged fluid from the sample collection vessel into the hydrocarbon production system, and may comprise controlling the decanting of the pre-charged fluid from the sample collection vessel using the test hot stab apparatus. Decanting the pre-charged fluid from the sample collection vessel may comprise flushing the sampling hot stab apparatus.

The method may comprise controlling the collection of production fluid into the sample collection vessel using the test hot stab apparatus.

The method may comprise flushing the sampling hot stab apparatus using a hydraulic fluid source coupled to the test hot stab apparatus, and/or may comprise controlling the flow of fluid through the sampling hot stab apparatus using the test hot stab apparatus.

The sampling hot stab apparatus may be a hot stab apparatus according to an embodiment of the tenth aspect of the invention, and the method may comprise actuating movement of the spool and fluid barrier of the hot stab apparatus using the test hot stab apparatus.

Embodiments of the eleventh aspect of the invention may include one or more features of the first to tenth aspects of the invention or their embodiments, or vice versa.

According to a twelfth aspect of the invention there is provided a system for collecting a sample of fluid from a hydrocarbon production system, the system comprising:

a subsea hydraulic circuit comprising a sample collection vessel, a connection apparatus, and a receptacle for a hydraulic interface apparatus;

wherein the connection apparatus is configured to be coupled to the production system to connect the hydraulic circuit to the production system;

wherein the hydraulic circuit is configured to enable a production fluid to be delivered to the sample collection vessel via the connection apparatus;

and wherein the hydraulic circuit is configured to enable flushing of at least the connection apparatus.

The hydraulic circuit may be configured to enable flushing of the connection apparatus by actuation of the hydraulic interface apparatus, and/or may be configured to enable flushing of the connection apparatus from a hydraulic fluid source coupled to the hydraulic interface apparatus.

The hydraulic circuit may be configured to enable flushing of the connection apparatus with a pre-charged fluid decanted from the sample collection chamber.

The connection apparatus may be a connection apparatus according to the tenth aspect of the invention.

The hydraulic interface apparatus is an ROV test hot stab. In one embodiment, the system comprises a combined fluid injection and sampling apparatus.

Embodiments of the twelfth aspect of the invention may include one or more features of the first to eleventh aspects of the invention or their embodiments, or vice versa.

According to a thirteenth aspect of the invention there is provided a remotely operated vehicle comprising the connection apparatus of the ninth aspect of the invention.

Embodiments of the thirteenth aspect of the invention may include one or more features of the first to twelfth aspects of the invention or their embodiments, or vice versa.

According to a fourteenth aspect of the invention there is provided a subsea production fluid sample collection system comprising the connection apparatus of the tenth aspect of the invention.

Embodiments of the fourteenth aspect of the invention may include one or more features of the first to thirteenth aspects of the invention or their embodiments, or vice versa.

According to a fifteenth aspect of the invention there is provided a combined fluid injection and sampling apparatus for a subsea oil and gas production flow system, the apparatus comprising:

a body defining a conduit therethrough;

a first connector for connecting the body to the flow system;

a second connector for connecting the body to a fluid injection apparatus;

wherein, in use, the conduit provides an injection path from the intervention apparatus to the flow system;

and wherein the apparatus further comprises a sampling subsystem for collecting a fluid sample from the flow system.

Preferably the sampling chamber is in fluid communication with the flow system via the first connector.

The apparatus preferably comprises a third connector for connecting the apparatus to a downstream flowline such as a jumper flowline. Therefore the apparatus may be disposed between a flowline connector and a jumper flowline, and may provide a flow path from the flow system to the jumper flowline, and may also establish an access point to the flow system, via the conduit and the first connector.

The second connector may comprise a hose connector. The apparatus may comprise a hose connection valve, which may function to shut off and/or regulate flow from a connected hose through the apparatus. The hose connection valve may comprise a choke, which may be adjusted by an ROV (for example to regulate and/or shut off injection flow).

Preferably the apparatus comprises an isolation valve between the first connector and the second connector. The isolation valve preferably has a failsafe close condition, and may comprise a ball valve or a gate valve. The apparatus may comprise a plurality of isolation valves.

The sampling subsystem may comprise an end effector, which may be configured to divert flow to a sampling chamber of the sampling subsystem of the apparatus, for example by creating a hydrodynamic pressure.

An inlet to the sampling chamber may be fluidly connected to the first connector. An outlet to the sampling chamber may provide a fluid path for circulation of fluid through the chamber and/or exit to a flowline.

Preferably, the sampling subsystem comprises a sampling port, and may further comprise one or more sampling needle valves. The sampling subsystem may be configured for use with a sampling hot stab.

The sampling subsystem may be in fluid communication with the flow system via a flow path extending between the first and third connectors. Alternatively or in addition the sampling subsystem may be in fluid communication with the flow system via a flow path extending between the first and third connectors.

Alternatively or in addition the sampling subsystem may be in fluid communication with the flow system via at least a portion of an injection bore.

Embodiments of the fifteenth aspect of the invention may include one or more features of the first to fourteenth aspects of the invention or their embodiments, or vice versa. In particular, apparatus or systems of the first to ninth aspects of the invention may be configured with a sampling subsystem as described (to be used with in a sampling operation) and/or an injection flow path (for use in an injection operation), and the apparatus or systems of the first to ninth aspects of the invention may be configured for just one of sampling or injection.

According to a sixteenth aspect of the invention there is provided a subsea oil and gas production system comprising:

a subsea well; a subsea Christmas tree in communication with the well; and a combined fluid injection and sampling unit;

wherein the a combined fluid injection and sampling unit comprises a first connector connected to the flow system and a second connector for connecting the body to an intervention apparatus;

wherein, in use, the conduit provides an injection path from an injection apparatus to the flow system;

and wherein the apparatus further comprises a sampling subsystem for collecting a fluid sample from the flow system.

The system may further comprise an injection hose, which may be connected to the combined fluid injection and sampling unit. The hose may comprise an upper hose section and a subsea hose section. The upper and subsea hose sections may be joined by a weak link connector. The weak link connector may comprise a first condition, in which the connection between the upper hose and the subsea hose is locked, and a second (operable) condition, in which the upper hose is releasable from the subsea hose.

Embodiments of the sixteenth aspect of the invention may include one or more features of the first to fifteenth aspects of the invention or their embodiments, or vice versa.

According to a seventeenth aspect of the invention there is provided a method of performing a subsea intervention operation, the method comprising:

providing a subsea well and a subsea flow system in communication with the well;

providing a combined fluid injection and sampling apparatus on the subsea flow system, the combined fluid injection and sampling apparatus comprising a first connector for connecting the apparatus to the flow system and a second connector for connecting the apparatus to a fluid injection apparatus;

connecting an injection hose to the second connector;

accessing the subsea flow system via an injection bore between the first and second connectors.

Preferably the access hub is pre-installed on the subsea flow system and left in situ at a subsea location for later performance of a subsea intervention operation. The injection hose may then be connected to the pre-installed unit and the method performed.

Preferably the method is a method of performing a fluid intervention operation. The method may comprise fluid sampling, fluid diversion, fluid recovery, fluid injection, fluid circulation, fluid measurement and/or fluid metering.

The method may be a method of performing a well scale squeeze operation.

The method may comprise performing a well fluid sampling operation. A preferred embodiment of the invention comprises: (a) performing a fluid injection operation; and (b) performing a well fluid sampling operation. Preferably the fluid injection operation and the well fluid sampling operation are both carried out by accessing the subsea flow system via the intervention path of the access hub.

Embodiments of the seventeenth aspect of the invention may include one or more features of the first to sixteenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
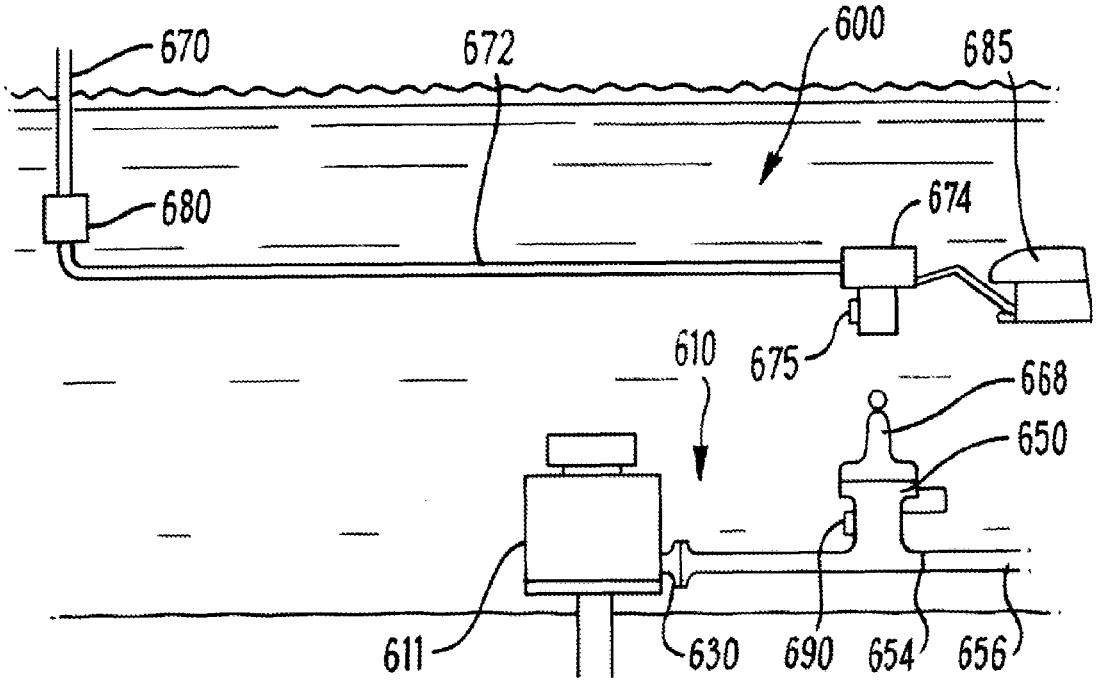
FIGS. 1A and 1B show schematically a subsea system in accordance with an embodiment of the invention, used in successive stages of a well squeeze operation.
Figure 1B:
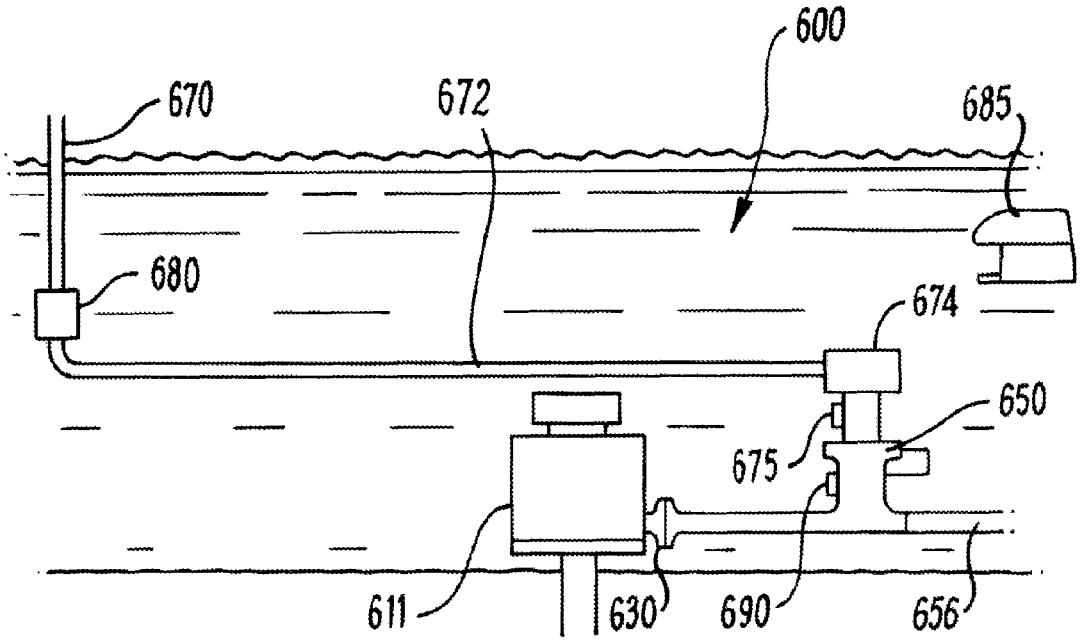
Figure 2A:
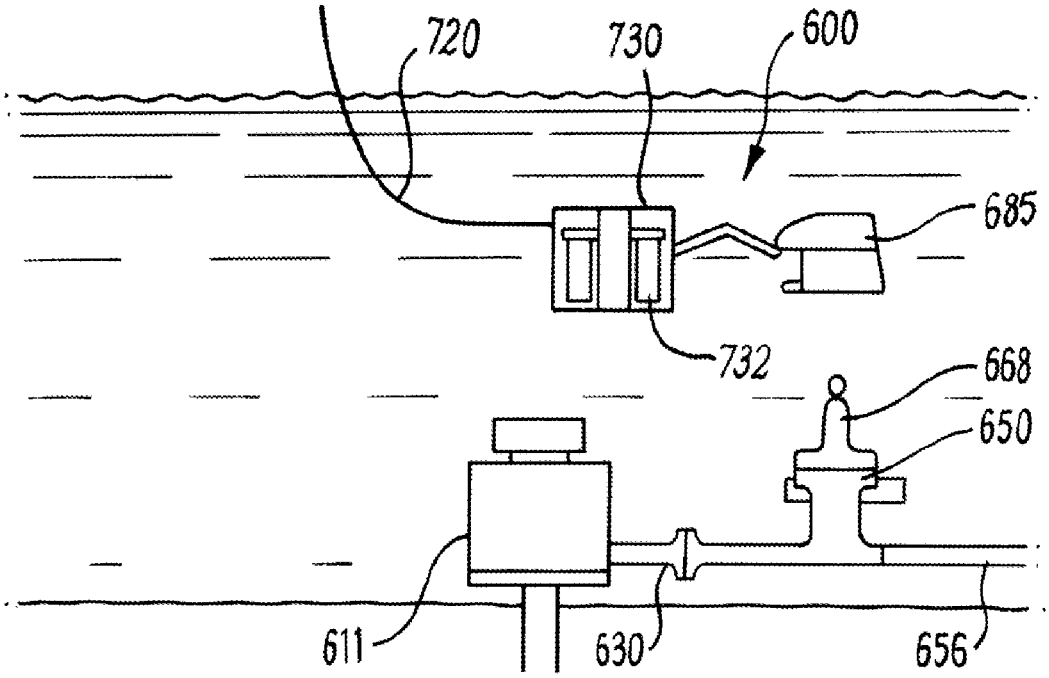
FIGS. 2A and 2B show schematically the subsea system of FIGS. 1A and 1B used in successive stages of a production fluid sample operation.
Figure 2B:
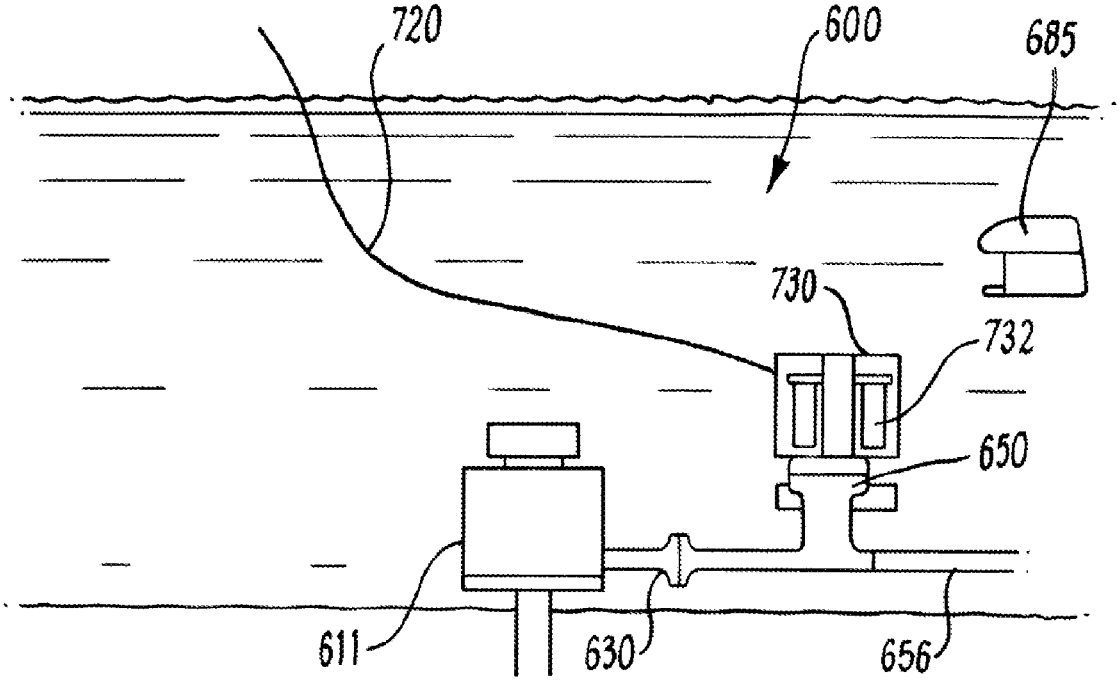
Figure 3:
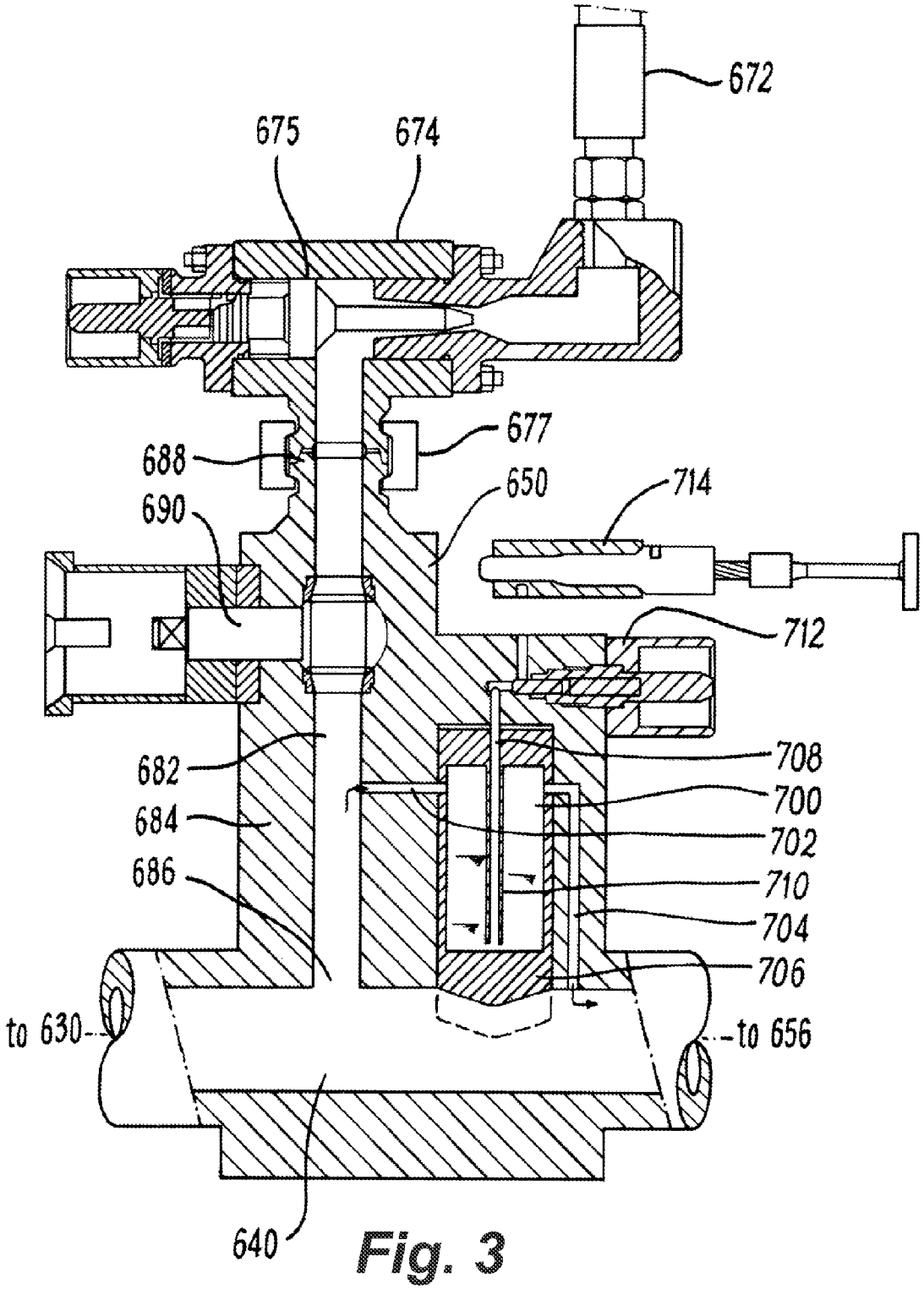
FIG. 3 is a sectional view of a combined injection and sampling hub used in the systems of FIGS. 1 and 2, when coupled to an injection hose connection.

Referring firstly to FIGS. 1 to 3, a combined injection and sampling system will be described. The system, generally depicted at 600, is shown schematically in different stages of a subsea injection operation in a well squeeze application in FIGS. 1A and 1B and in a sampling mode as described below with reference to FIGS. 2A and 2B. A hub 650, configured as a combined sampling and injection hub used in the methods of FIGS. 1 and 2, is shown in more detail in FIG. 3.

The system 600 comprises a subsea flow system 610 which includes subsea manifold 611. The subsea manifold 611 is a conventional vertical dual bore Christmas tree (with internal tree components omitted for simplicity), and the system 600 utilises a hub 650 to provide access to the flow system 610. A flowline connector 630 of a production branch outlet conduit (not shown) is connected to the hub 650 which provides a single access point to the system. At its opposing end, the hub 650 comprises a standard flowline connector 654 for coupling to a conventional jumper 656. In FIG. 1A, the hub 650 is shown installed with a pressure cap 668. Optionally a debris and/or insulation cap (not shown) may also be provided on the pressure cap 668.

The system 600 also comprises an upper injection hose 670, deployed from a surface vessel (not shown). The upper injection hose 670 is coupled to a subsea injection hose 672 via a weak link umbilical coupling 680, which functions to protect the subsea equipment, including the subsea injection hose 672 and the equipment to which it is coupled from movement of the vessel or retrieval of the hose. The subsea injection hose 672 is terminated by a hose connection termination 674 which is configured to be coupled to the hub 650. The hub 650 is configured as a combined sampling and injection hub, and is shown in more detail in FIG. 3 (in a condition connected to the hose connection 674 in the mode shown in FIG. 1B).

As shown most clearly in FIG. 3, the hose connection termination 674 incorporates a hose connection valve 675, which functions to shut off and regulate injection flow. The hose connection valve 675 in this example is a manual choke valve, which is adjustable via an ROV to regulate injection flow from the hose 672, through the hose connection 674 and into the hub 650. The hose connection 674 is connected to the hub via an ROV style clamp 677 to a hose connection coupling 688.

The hub 650 comprises an injection bore 682 which extends through the hub body 684 between an opening 686 from the main production bore 640 and the hose connection coupling 688. Disposed between the opening 688 and the hose connection coupling 688 is an isolation valve 690 which functions to isolate the flow system from injection flow. In this example, a single isolation valve is provided, although alternative embodiments may include multiple isolation valves in series. The isolation valve 690 is a ball valve, although other valve types (including but not limited to gate valves) may be used in alternative embodiments of the invention. The valve 690 is designed to have a fail-safe closed condition (in embodiments with multiple valves at least one should have a fail-safe closed condition).

The hub 650 is also provided with a sampling chamber 700. The sampling chamber comprises an inlet 702 fluidly connected to the injection bore 682, and an outlet 704 which is in fluid communication with the main production bore 640 downstream of the opening 686. The sampling chamber 700 is provided with an end effector 706, which may be pushed down into the flow in the production bore 640 to create a hydrodynamic pressure which diverts flow into the injection bore 682 and into the sampling chamber 700 via the inlet 702. Fluid circulates back into the main production bore via the outlet 704.

In an alternative configuration the inlet 702 may be fluidly connected directly to the production bore 640, and the end effector 706 may cause the flow to be diverted into the chamber 700 directly from the bore 640 via the inlet.

The sampling chamber 700 also comprises a sampling port 708, which extends via a stem 710 into the volume defined by the sampling chamber. Access to the sampling port 708 is controlled by one or more sampling needle valves 712. The system is configured for use with a sampling hot stab 714 and receptacle which is operated by an ROV to transfer fluid from the sampling chamber into a production fluid sample bottle (as will be described below with reference to FIGS. 2A and 2B).

The operation of the system 600 in an application to a well squeeze operation will now be described, with reference to FIGS. 1A and 1B. The operation is conveniently performed using two independently operated ROV spreads, although it is also possible to perform the operation with a single ROV. In the preparatory steps a first ROV (not shown) inspects the hub 650 with the pressure cap 668 in place, in the condition as shown in FIG. 1A. Any debris or insulation caps (not shown) are detached from the hub 650 and recovered to surface by the ROV. The ROV is then used to inspect the system for damage or leaks and to check that the sealing hot stabs are in position. The ROV is also used to check that the tree and/or jumper isolation valves are closed. Pressure tests are performed on the system via the sealing hot stab (optionally a full pressure test is performed), and the cavity is vented. The pressure cap 668 is then removed to the ROV tool basket, and can be recovered to surface for inspection and servicing if required.

The injection hose assembly 670/672 is prepared by setting the weak link coupling 680 to a locked position and by adjusting any trim floats used to control its buoyancy. The hose connection valve 675 is shut off and the hose is pressure tested before setting the hose pressure to the required deployment value. A second ROV 685 is deployed below the vessel (not shown) and the hose is deployed overboard to the ROV. The ROV then flies the hose connection 674 to the hub 650, and the connection 674 is clamped onto the hub and pressure tested above the isolation valve 690 via an ROV hot stab. The weak link 680 is set to its unlocked position to allow it to release the hose 670 from the subsea hose 672 and the hub 650 in the event of movement of the vessel from its location or retrieval of the hose.

The tree isolation valve is opened, and the injection hose 672 is pressurised to the desired injection pressure. The hose connection valve 675 is opened to the desired setting, and the isolation valve is opened. Finally the production wing isolation valve is opened to allow injection flow from the hose 672 to the production bore to commence and the squeeze operation to be performed. On completion, the sequence is reversed to remove the hose connection 674 and replace the pressure cap 668 and any debris/insulation caps on the hub 650.

It is a feature of this aspect and embodiment of the invention that the hub 650 is a combined injection and sampling hub; i.e. the hub can be used in an injection mode (for example a well squeeze operation as described above) and in a sampling mode as described below with reference to FIGS. 2A and 2B.

The sampling operation may conveniently be performed using two independently operated ROV spreads, although it is also possible to perform this operation with a single ROV. In the preparatory steps, a first ROV (not shown) inspects the hub 650 with its pressure cap 668 in place (as shown in FIG. 2A). Any debris or insulation cap fitted to the hub 650 is detached and recovered to surface by a sampling Launch and Recovery System (LARS) 720. The ROV is used to inspect the system for damage or leaks, and to check that the sealing hot stabs are in position.

The sampling LARS 720 subsequently used to deploy a sampling carousel 730 from the vessel (not shown) to depth and a second ROV 685 flies the sampling carousel 730 to the hub location. The pressure cap 668 is configured as a mount for the sampling carousel 730. The sampling carousel is located on the pressure cap locator, and the ROV 685 indexes the carousel to access the first sampling bottle 732. The hot stab (not shown) of the sampling bottle is connected to the fluid sampling port 708 to allow the sampling chamber 700 to be evacuated to the sampling bottle 732. The procedure can be repeated for multiple bottles as desired or until the bottles are used.

On completion, the sample bottle carousel 730 is detached from the pressure cap 668 and the LARS 720 winch is used to recover the sample bottle carousel and the samples to surface. The debris/insulation cap is replaced on the pressure cap 668, and the hub is left in the condition shown in FIG. 2A.

Figure 5:
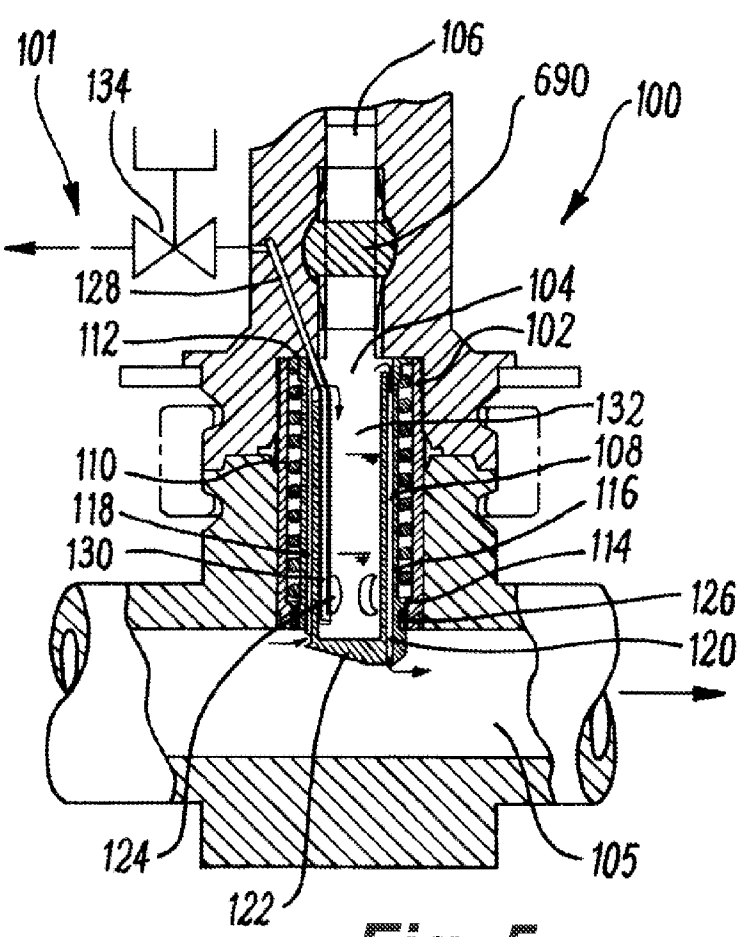
FIG. 5 is a sectional view of the sampling chamber of FIG. 4 in a sampling mode.
Figure 4:
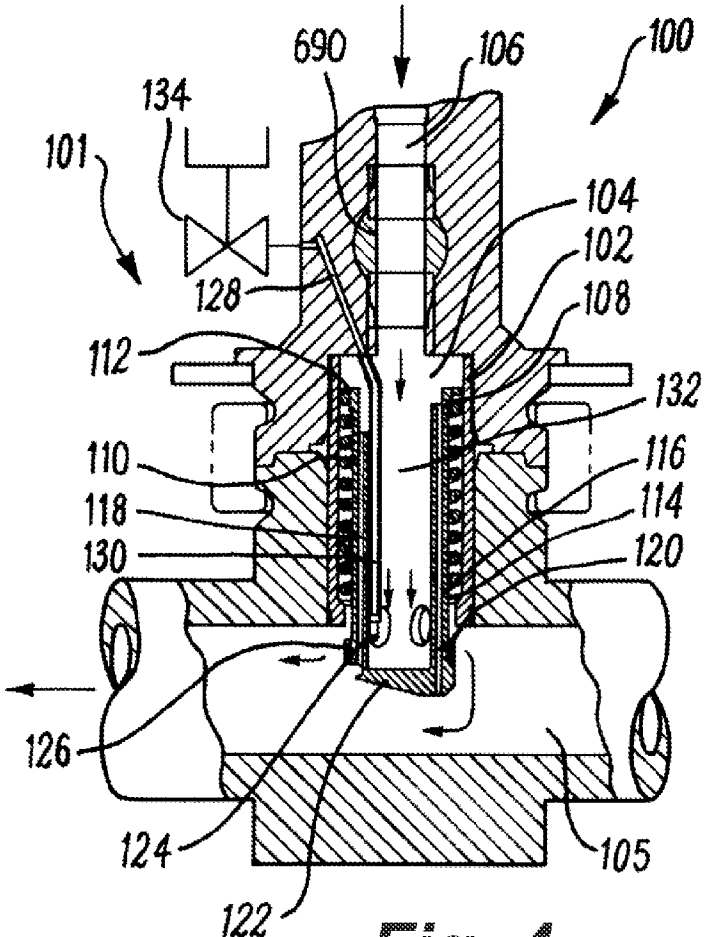
FIG. 4 is a sectional view of a sampling chamber which may be used with the combined injection and sampling system of FIG. 3 in an embodiment of the invention, shown in an injection mode.

The embodiment described with reference to FIG. 3 has a particular configuration of combined injection and sampling unit, but other configurations are within the scope of the invention, including those with differing flow control valve and isolation valve configurations. Furthermore, while the sampling chamber 700 of the unit 650 is suitable for many applications, it is desirable to provide a more compact unit which is particularly easy to deploy and install on a subsea flow system. FIGS. 4 and 5 are a sectional view of an improved sampling apparatus according to a preferred embodiment of the invention, in which a sampling chamber is configured for flow-through of injection fluids when an injection mode.

The sampling apparatus, generally shown at 100 in a combined injection and sampling unit 101, comprises a cylindrical body 102 which is located in an enlarged bore portion 104 of the injection bore 106. The cylindrical body 102 defines a volume which is a continuation of the injection bore, such that injection fluid flows downwards through the apparatus (and through the isolation valve 690) and into the enlarged bore portion. The cylindrical body supports a sleeve 108, which is slidable (i.e. moves axially) within the cylindrical body and enlarged bore portions. A spring 110 located between the cylindrical body and the sleeve urges the sleeve towards an upward position (shown in FIG. 5). An annular shoulder 112 at the top end of the sleeve and an annular shoulder 114 at a lower end of the cylindrical body provide respectively upper and lower bearing surfaces for the spring 110. A secondary shoulder 116 is provided on an outer surface of the sleeve 108 part way along its length.

The lower end of the sleeve 108 is closed (other than a sampling inlet 118 and a sampling outlet 120 which will be described in more detail below) by a profiled end cap 122. The sleeve is provided with radial ports 124, circumferentially arranged around the sleeve and located towards a lower end of the sleeve. When the sleeve is in its upper condition, as shown in FIG. 5, the radial ports 124 are retracted into the cylindrical body 102. An elastomeric seal ring 126 provides an annular seal between the sleeve and the cylinder when the sleeve is in an upper retracted position, as shown in FIG. 5.

The sampling apparatus 100 also comprises a sampling port 128, which extends via a stem 130 into a sampling chamber 132. Access to the sampling port 128 is controlled by one or more sampling needle valves 134. The sampling apparatus is configured for use with a sampling hot stab and a receptacle which is operated by an ROV to transfer fluid from the sampling chamber into a production fluid sample bottle as will be described below.

The embodiment described with reference to FIGS. 4 and 5 provides a highly compact construction, with the sampling chamber 132 located coaxially with an injection bore 106. This reduces the overall size and weight of the apparatus, rendering it particularly suitable for subsea deployment operations.

This embodiment offers the additional advantage that it can be operated in an injection mode. During injection of fluids via the injection bore 106, fluid passes into the enlarged bore portion 104 and into the interior of the sleeve 108. Pressure increases on the interior of the sleeve until the force on the sleeve overcomes the biasing force due to the spring 110. The spring is compressed and the sleeve moves downwards until the secondary shoulder 116 of the sleeve engages with the lower shoulder 114 on the cylindrical body, as shown in FIG. 4. In this position, the radial ports 124 are open to the main production bore 105, and the injection fluid flows out of the injection bore and into the production bore to the reservoir. The spring force is selected such that the sleeve is only opened in the presence of a sufficient injection pressure in the injection bore. When injection stops, the spring force retracts the sleeve into the cylinder, to the position shown in FIG. 5.

In a sampling mode there is no injection flow, and the isolation valve 690 is closed. The sleeve is in its upper position in the cylindrical body, as shown in FIG. 5. The profiled end cap 122 of the sleeve 108 is partially inserted into the main production bore 105, and is configured to create a Venturi effect which reduces pressure in the main product bore adjacent the sampling outlet 120. A pressure differential between the sampling outlet 120 and sampling inlet 118 causes fluid in the main production bore to be driven into the sampling chamber via the sampling inlet. Fluid circulates back into the main production bore via the sampling outlet 120. The Venturi effect can be moderated by changing the profile of the end cap 122 and/or the depth at which the end cap is set into the flow. It will be appreciated that flow of fluid into the chamber may also (or alternatively) be facilitated by externally creating a small pressure drop between the inlet and the outlet, for example by locating a flow restriction device such as a valve or Venturi profile in the main flow bore between the sampling inlet and sampling outlet positions.

The circulation of fluid through the chamber 132 ensures that the selected fluids are a representative sample of the recent flow composition (rather than a "stale" fluid sample). This is facilitated by designing the chamber with appropriate positioning of internal baffles and tube runs. In addition, the positioning of internal baffles and tube runs is such that liquids are preferentially retained in the sampling chamber (rather than gas phase fluids). For example, the internal opening of the sampling outlet tube is located in an upper part of the internal volume of the sampling chamber so that it tends to draw out any gas in the chamber via the sampling outlet.

When collection of a sample is required, an ROV operates the sampling needle valve 134 to allow pressure in the sampling chamber to drive the fluid from the sampling chamber, through the sampling port, to a collection vessel via a series of valves and flow lines.

Figure 6:
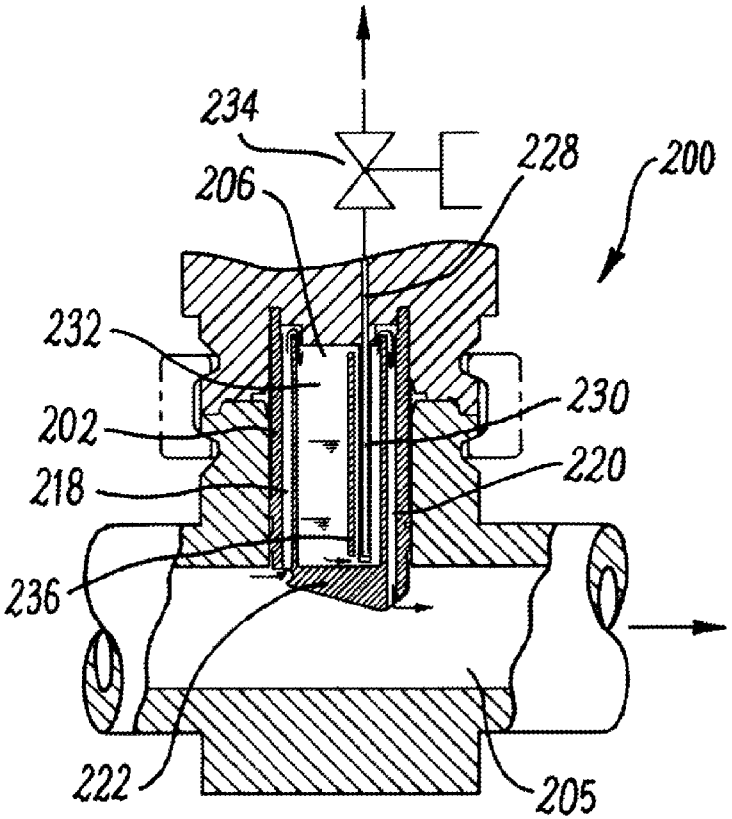
FIG. 6 is a sectional view of a sampling chamber according to an alternative embodiment of the invention.

Although the embodiment described with reference to FIGS. 4 and 5 is configured for use in the combined injection and sampling application, its compact size and relative simplicity also renders it suitable for dedicated sampling of systems and processes (i.e. those which do not need to allow for the passage of injection fluids). FIG. 6 is a sectional view of a dedicated sampling apparatus, generally shown at 200, comprises a cylindrical body 202 which is located in a side bore 206 formed to a main production bore 205 in the subsea flow system, and is similar to the sampling apparatus 700 of FIG. 3. A lower end of the cylindrical body 202 is closed (other than a sampling inlet 218 and a sampling outlet 220 which will be described in more detail below) by a profiled end cap 222, which is similar in form and function to the profiled end cap 122 of the sampling apparatus 122 of FIGS. 4 and 5. The cylindrical body 202 is in a fixed orientation in the side bore 206. A sampling port 228 extends via a stem 230 into a sampling chamber 232 defined by the cylindrical body, and access to the sampling port is controlled by one or more sampling needle valves 234. As before, the sampling apparatus 200 is configured for use with a sampling hot stab and a receptacle which is operated by an ROV to transfer fluid from the sampling chamber into a production fluid sample bottle.

Operation of the sampling apparatus 200 is as described with reference to the previous embodiment when in its sampling mode: the profiled end cap 222 of the apparatus 200 is partially inserted into the main production bore 205, and creates a Venturi effect which reduces pressure in the main flow bore adjacent the sampling outlet 220. Fluid circulates back into the sampling chamber via the inlet 218 and back into the main production bore via the sampling outlet 220. The Venturi effect can be moderated by changing the profile of the end cap 222 and/or the depth at which the end cap is set into the flow, and may be facilitated by externally creating a small pressure drop between the inlet and the outlet. An internal baffle 236 and tubes are positioned to obtain representative samples and preferentially retain liquids in the sampling chamber (rather than gas phase fluids).

Figure 7:
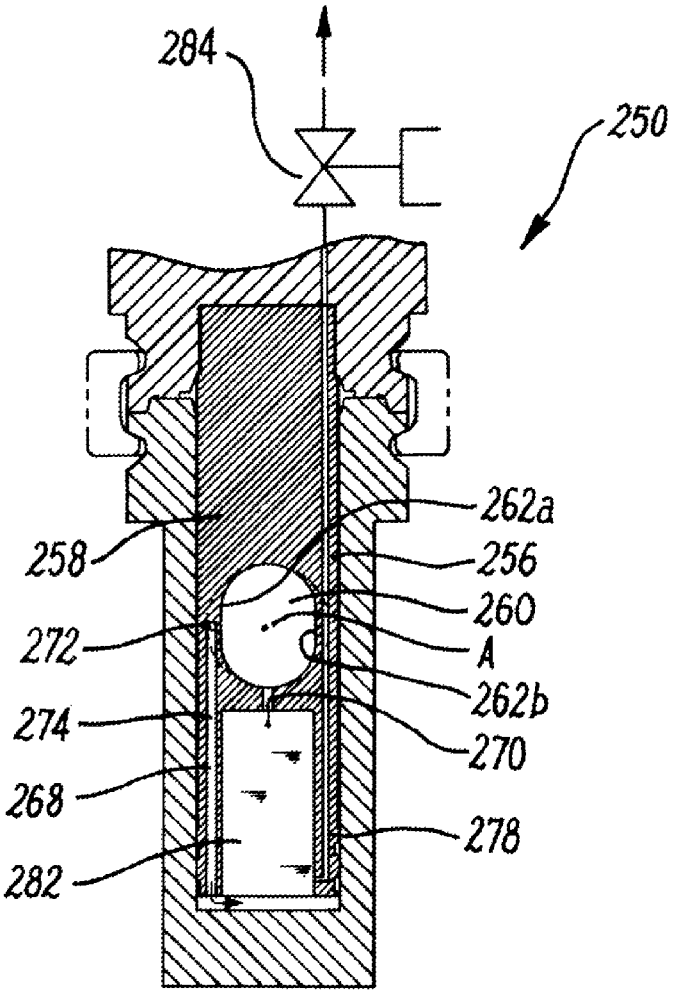
FIG. 7 is a sectional view of a sampling chamber according to an alternative embodiment of the invention.

A sampling apparatus 250 according to an alternative embodiment of the invention is shown in sectional view in FIG. 7. The Figure is a longitudinal section through a sampling side bore 256, perpendicular to an axial direction of a main production flow bore. The sampling apparatus 250 of this embodiment is gravity assisted and facilitates the collection of liquids into the chamber. The side bore 256 extends across and below the axis A of the main production bore. A sampling block 258 is accommodated in the side bore and defines a sampling chamber volume 282 located below the main production bore. The block 258 also defines flow conduits in the apparatus. The sampling block 258 comprises an aperture 260 which is aligned with substantially coaxially with the main production bore. However, the aperture 260 is profiled to create a reduced diameter section in the production bore. In this example, the reduced diameter section is substantially oval, with two side protrusions 262*a*, 262*b* which impinge into the flow path which corresponds to the main production bore. The sampling block 258 is also provided with a sampling inlet 268 and a sampling outlet 270. The sampling inlet 268 comprises an opening 272 formed in one side protrusion of the block, substantially facing the direction of fluid flow in the main bore. This opening connects to a fluid conduit 274 which is formed in the axial direction of the side bore and the block, to direct flow to a lower end of the block where it is in communication with the sampling chamber 282. The outlet 270 is provided in the sampling block between the aperture and the sampling chamber and provides a recirculation path for the production fluid. The apparatus also comprises a sampling port 278 which extends from the lower part of the sampling chamber to a sampling bottle via a system of valves and flow conduits 284.

In use, fluid flow through the main bore impinges on the side protrusions 262*a*, 262*b* created by the aperture profile of the sampling block. A proportion of the fluid flow enters the opening to the sampling inlet 268, and is redirected down the fluid conduit 274 of the inlet to enter the sampling chamber 282. The fluid is circulated out of the outlet 270 and back into the aperture 256 to join the main production bore. Flow through the sampling chamber via the inlet and outlet is assisted by a Venturi effect created by the restricted flow portion which creates a pressure drop between the inlet and the outlet. In addition, flow into the inlet is assisted by gravity. This embodiment has particular benefits in collecting liquid phase fluids which tend to pass along the walls of the production bore, as opposed to gas phase fluids which preferentially travel along the centre of the bore.

It will be appreciated that in other configurations, the aperture may have a different shape (e.g. may be circular or asymmetrical) and may comprise multiple openings to one or more sampling inlets.

The sampling apparatus configurations of FIGS. 4 to 7 are compact in size, low in weight, and have few (or no) moving parts. They provide flow through sampling chambers which facilitate the collection of representative samples of production fluids. The small size and weight lends the design to subsea deployment and installation, and moreover provide a wide range of installation options. In particular, the sampling apparatus of aspects and embodiments of the invention are suitable for installation in locations very close to the flowline, so that the chamber is maintained at the temperature of the flowing production fluid, and the sampling apparatus may be located close to a manifold such as a Christmas tree. The invention is particularly suitable for use and/or incorporation with hubs and/or hub assemblies which facilitate convenient intervention operations by facilitating access to the flow system in a wide range of locations. These include locations at or on the tree, including on a tree or mandrel cap, adjacent the choke body, or immediately adjacent the tree between a flowline connector or a jumper. Alternatively the apparatus of the invention may be used in locations disposed further away from the tree. These include (but are not limited to) downstream of a jumper flowline or a section of a jumper flowline; a subsea collection manifold system; a subsea Pipe Line End Manifold (PLEM); a subsea Pipe Line End Termination (PLET); and/or a subsea Flow Line End Termination (FLET).

Embodiments of the invention use remotely operated vehicle (ROV) hot stab systems for hydraulic control and fluid sampling. ROV hot stab tools are known in the art, but are generally limited to basic fluid line coupling applications. Conventional ROV hot stabs have at best limited sealing capabilities which often result in discharge of fluids to the surrounding environment. In hydraulic control applications, this may not be a significant problem; hydraulic fluids are of known composition and the discharge to a subsea environment may not be a significant environmental issue. Nevertheless, loss or discharge of some hydraulic fluids may generally be undesirable, particularly in low- or zero-discharge production regimes. More significantly, in sampling applications the discharge of production fluid samples leads to potential for environmental contamination. In sampling applications it is also desirable to have the ability to completely flush an ROV hot stab to avoid contamination between different production fluid samples. Preferred embodiments of the invention therefore use improved hot stab designs will be described with reference to FIGS. 8A and 8B (and which also form an alternative aspect of the invention).

Figure 8B:
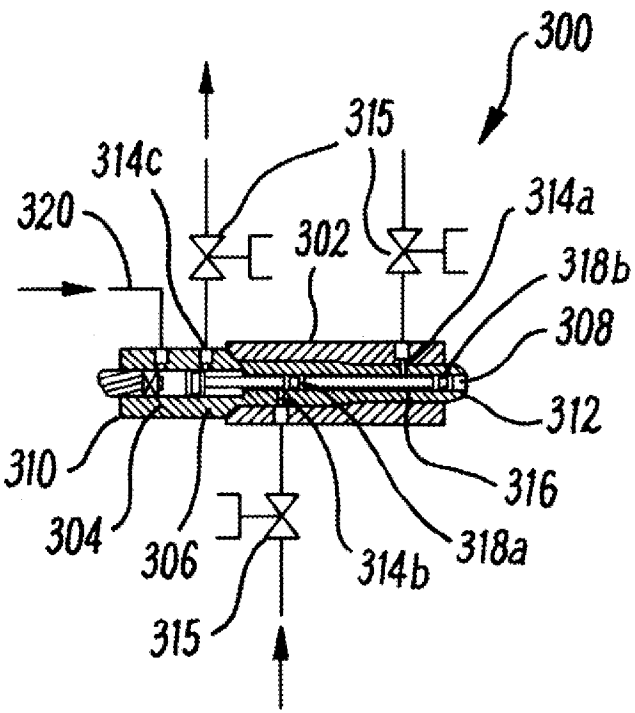
FIGS. 8A and 8B are sectional views of a sampling tool according to an embodiment of the invention, in closed and open positions respectively.
Figure 8A:
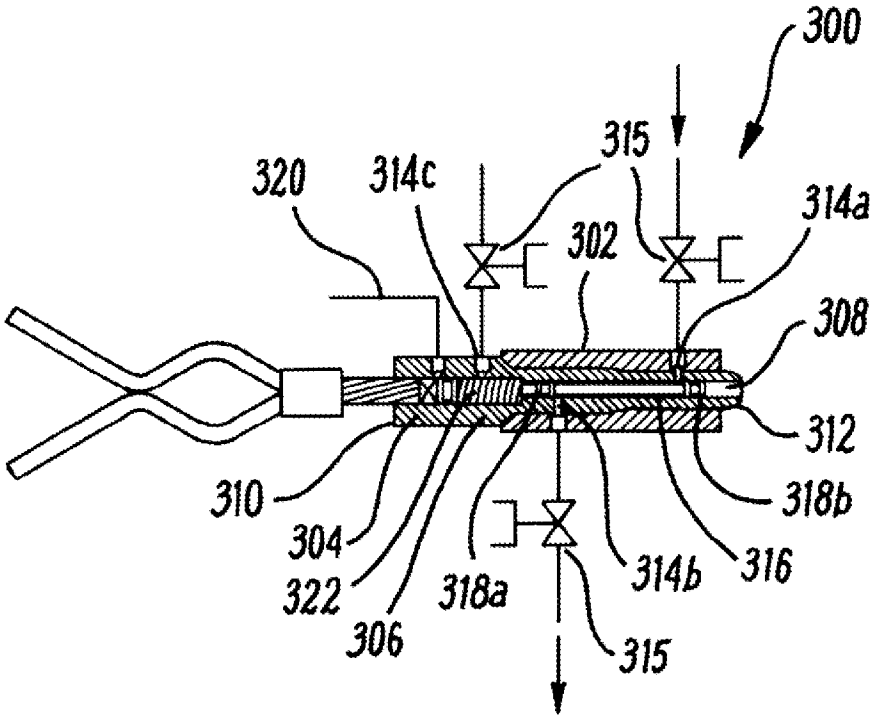

FIG. 8A is a sectional view of a hot stab and receptacle combination, generally shown at 300. The hot stab receptacle 302 is a standard receptacle, as is found a range of subsea equipment including existing isolation valve testing and control blocks and sampling valve blocks. The hot stab 304 comprises a hot stab body 306 configured with appropriate shape and dimensions to be received in the standard hot stab receptacle 304.

The hot stab 304 differs from a conventional hot stab in that it comprises an internal bore 308 which is axially aligned and extends through the hot stab body 306 from a control end 310 to a leading end 312 of the body. First, second and third radial ports 314*a*, 314*b*, 314*c* to the internal bore are located in axially separated positions along the hot stab body 306, with associated needle valves 315. The hot stab 304 is also provided with an internal valve, comprising a directional control spool 316 which can be moved between different positions in the hot stab body 306 to control various flow combinations. Flow barriers 318*a*, 318*b* are located in axially separated positions on the spool 316 to control the axial flow paths through the hot stab.

In the position shown in FIG. 8A, the directional control spool is located in a closed position, with the spool disposed away from the leading end 312 of the hot stab (to the left as drawn). In this condition, fluid is free to flow from port 314*a* to port 314*b*, via the internal bore and between the flow barriers 318 of the directional control spool.

FIG. 8B shows the hot stab 304 in an open position, in which the directional control spool 316 has been moved further into the hot stab body (to the right as drawn) towards the leading end 312. The movement of the directional control spool moves the flow barrier 318*a* in the control spool from one side of the port 314*b* to the opposing side of the opening 314*b*. The flow barrier 318*a* in this position prevents flow between port 314*a* and port 314*b*, but opens a flow path between port 314*b* and port 314*c*.

In this embodiment, the hot stab is energised by a hydraulic signal from line 320, although in alternative embodiments an electrical actuation signal can be provided. Also in this embodiment (and as shown in FIG. 8A) the hot stab is provided with a closing spring 322 which biases the position of the directional control spool 316 to the closed position (to the left as shown).

The addition of an axial bore 308 and directional control spool 316 to a hot stab converts the hot stab and receptacle combination into a directional control valve (with two positions in the example described above). A hot stab derived directional control valve as described has many practical applications, including but not limited to taking fluid samples from subsea oil and gas flow systems and infrastructure. Application to a fluid sampling system will now be described by way of example only with reference to FIG. 9.

Figure 9:
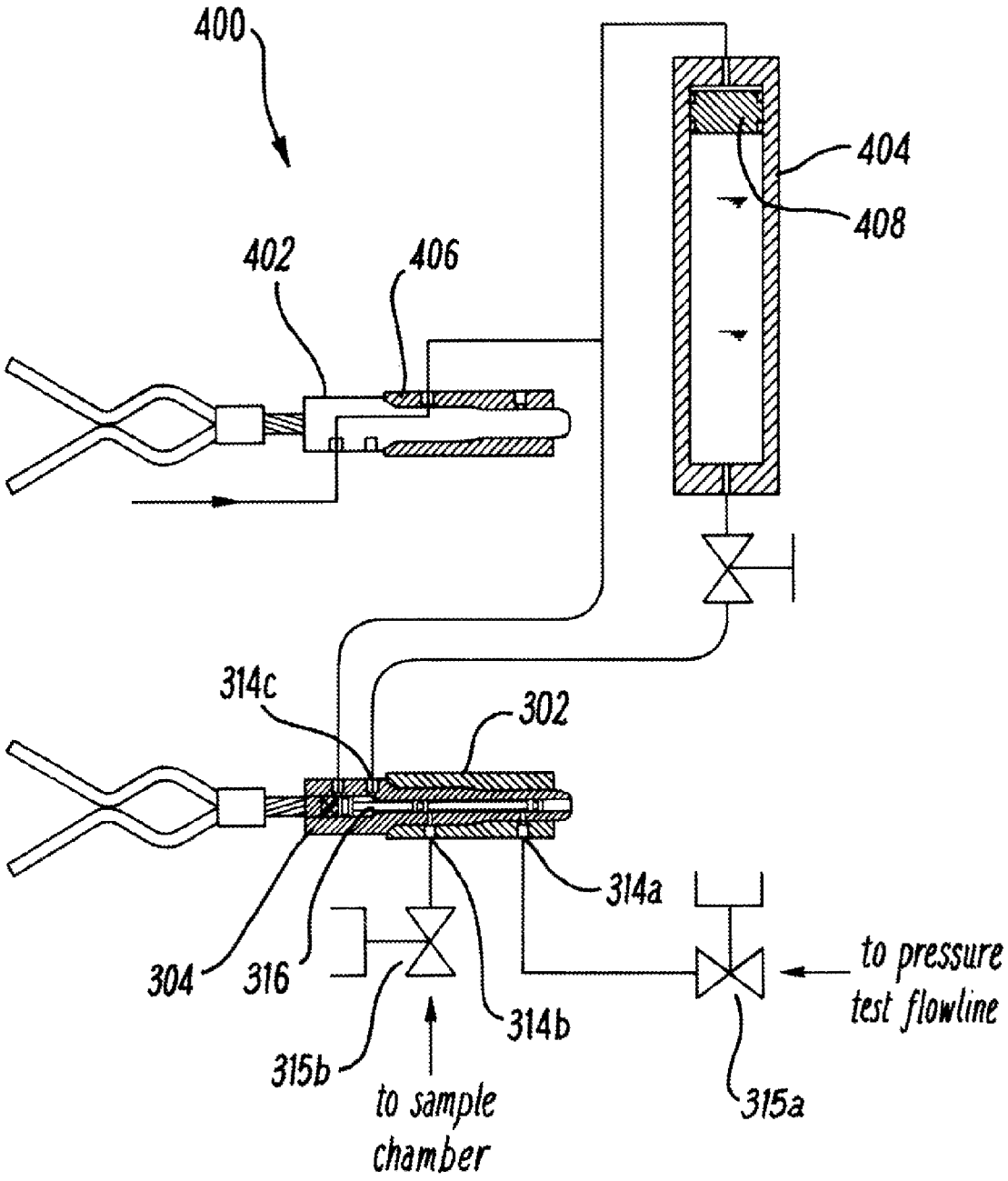
FIG. 9 is a schematic view of a sampling test circuit according to an embodiment of the invention.

FIG. 9 is a schematic view of a sampling circuit, generally shown at 400, which utilises an ROV test hot stab 402 and an ROV sampling hot stab 304 to deliver a sampling fluid to a sample collection vessel 404. The sample collection vessel 404 is pre-charged with an inert fluid such as nitrogen. The sampling hot stab 304 is a valved hot stab as described with reference to FIGS. 8A and 8B, and is associated with the sample collection vessel 404, initially docked into a test valve receptacle of the sample collection vessel.

In the preparatory steps, a sampling LARS (not shown) is used to deploy the sample collection vessel 404, which forms a part of a sampling carousel, to depth. An ROV flies the sample collection vessel 404 to the location of the sampling apparatus (not shown), which may for example be the apparatus of any of FIGS. 3 to 7. The sampling carousel is located on a pressure cap locator, and the ROV indexes the carousel to access the first sample collection vessel 404.

A sealing hot stab (not shown) is removed from receptacle 302 and parked in a spare receptacle on the carousel. The sampling hot stab 304 is removed from the test valve receptacle 406 of the sample collection vessel 404 and placed in the receptacle 302, as shown in FIG. 9. In the position shown, the directional valve formed by the hot stab 304 and receptacle 302 is closed, and provides a flow path between ports 314*a* and 314*b*. Port 314*b* is connected via a needle valve 315*b* to the sampling port of the sampling apparatus and port 314*a* is connected via a needle valve 315*a* to a pressure test flow line in an upper part of the sampling apparatus.

The ROV test hot stab 402 is located into the vacated sample collection vessel receptacle 406, and the ROV test hot stab 406 is pressurised to energise the internal spool valve 316 of the sampling hot stab 304 and simultaneously force down the sample collection vessel decanting piston 408. The sample hot stab 304 is opened to create a flow path from the port 314*c* (connected to the sample collection vessel) and the opening 314*b* (connected to the sampling port of the sampling chamber), and the fluid pre-charged in the sample collection vessel 404 is flushed through the sampling port, into the sampling chamber, and into the production bore, simultaneously cleaning all of the interconnection hoses and the sampling hot stab 304.

The test hot stab pressure is held for a period to allow sample chamber to stabilise, and then is slowly reduced to a value just below the flowing well pressure. This action allows the contents of the sample chamber to be pumped, by well pressure, under control into the sample collection vessel 404. The ROV monitors the sample collection vessel 404 until a piston indicator rod is seen rising through the sample collection vessel cap, and the test hot stab pressure is reduced to ambient pressure.

The sampling cavities, including the flow lines to the receptacle 302 and the sampling hot stab 304 itself can then be flushed by relocating the ROV test hot stab 402 in a test needle valve block (not shown) in communication with the sampling hot stab port 314*a*. With the sampling hot stab 304 closed, and the needle valve 315*b* initially closed, needle valve 315*a* is opened to expose the port 314*a* to hydraulic pressure from ROV test hot stab 402. The needle valve 315*b* is briefly opened and closed to flush fluid through the sampling cavities of the sampling hot stab 304. After pressure testing the needle valves 315, the sampling hot stab 304 is removed and located in the receptacle 406 of the sample collection vessel. The procedure can be repeated for multiple bottles as desired or until the bottles are used.

A significant advantage of the use of an internal valve hot stab as described is that in a sampling application, fluid conduit lines can be easily flushed, and potential environmental contamination associated with the leaking of production fluid samples to the subsea environment can be mitigated or eliminated. It will be appreciated that a range of other applications are facilitated by this aspect of the invention. By altering the control spool sealed positions, a number of different combinations of flow path may be incorporated into the design.

The invention in one of its aspects provides a connection apparatus for a subsea hydraulic circuit and method of use in a sampling application. The apparatus comprises a longitudinal body configured to be removably docked with a subsea hydraulic circuit receptacle. The body comprises a plurality of radial ports axially displaced along the body, and an axial bore accommodating a spool having at least one fluid barrier. The spool and fluid barrier are actuable to be axially moved in the bore to control axial flow paths along the bore between the plurality of radial ports. The apparatus may be configured as a sampling hot stab in an application to sampling a production fluid from a subsea hydrocarbon production system.

Aspects of the invention facilitate injection and sampling through a combined unit which provides an injection access point and a sampling access point. However, the invention in its various aspects also has application to a range of intervention operations, including fluid introduction for well scale squeeze operations, well kill, hydrate remediation, and/or hydrate/debris blockage removal; fluid removal for well fluid sampling and/or well fluid redirection; and/or the addition of instrumentation for monitoring pressure, temperature, flow rate, fluid composition, erosion and/or corrosion.

The apparatus and systems of embodiments described herein provide effective fluid sampling in a compact unit which is convenient, reliable, safe, and relatively low cost to deploy. The sampling apparatus of aspects and embodiments of the invention provide flexible operating options, including compatibility with control systems for injection and/or sampling operations.

Various modifications may be made within the scope of the invention as herein intended, and embodiments of the invention may include combinations of features other than those expressly described herein.

The invention claimed is:

1. A subsea production fluid sample collection system comprising:

a fluid sample collection vessel;

a subsea hydraulic circuit having a subsea hydraulic circuit receptacle; and a connection apparatus for a subsea hydraulic circuit;

wherein the connection apparatus comprises:

a longitudinal body configured to be removably docked with the subsea hydraulic circuit receptacle, the longitudinal body comprising a plurality of radial ports axially displaced along the body;

wherein the body comprises an axial bore accommodating a spool having at least one fluid barrier;

and wherein the spool and fluid barrier are actuable to be axially moved in the bore to control axial flow paths along the bore between the plurality of radial ports.

2. The system according to claim 1, wherein the fluid barrier is an annular fluid barrier arranged to seal an annulus between the spool and the bore.

3. The system according to claim 1, wherein the apparatus comprises at least three radial ports.

4. The system according to claim 3, wherein the spool and fluid barrier are actuable to be axially moved from a first position in which a flow path between a first port and a second port is open, and a second position in which a flow path between the second port and a third port is open.

5. The system according to claim 4, wherein in the first position, a flow path from the third port to the first or second ports is closed.

6. The system according to claim 4, wherein in the second position, a flow path from the first port to the second or third ports is closed.

7. The system according to claim 1, wherein the connection apparatus is configured to be coupled to a hydrocarbon production system to connect the subsea hydraulic circuit to the hydrocarbon production system;

wherein the subsea hydraulic circuit is configured to enable a production fluid to be delivered to the sample collection vessel via the connection apparatus;

and wherein the subsea hydraulic circuit is configured to enable flushing of at least the connection apparatus.

8. The system according to claim 7, further comprising a hydraulic interface apparatus and a receptacle for the hydraulic interface apparatus.

9. The system according to claim 8, wherein the subsea hydraulic circuit is configured to enable flushing of the connection apparatus by actuation of the hydraulic interface apparatus.

10. The system according to claim 9, wherein the subsea hydraulic circuit is configured to enable flushing of the connection apparatus from a hydraulic fluid source coupled to the hydraulic interface apparatus.

11. The system according to claim 10, wherein the subsea hydraulic circuit is configured to enable flushing of the connection apparatus with a pre-charged fluid decanted from the sample collection vessel.

12. The system according to claim 7, wherein the hydraulic interface apparatus is an ROV test hot stab.

13. The system according to claim 7, wherein the system comprises a combined fluid injection and sampling unit.

14. The system according to claim 1, wherein the connection apparatus is configured as a sampling hot stab apparatus on a remotely operated vehicle (ROV).

15. A subsea production fluid sample collection system comprising:

a subsea hydraulic circuit having a subsea hydraulic circuit receptacle; and a connection apparatus for a subsea hydraulic circuit;

wherein the connection apparatus comprises a longitudinal body configured to be removably docked with the subsea hydraulic circuit receptacle, the longitudinal body comprising a plurality of radial ports axially displaced along the body;

wherein the body comprises an axial bore accommodating a spool having at least one fluid barrier;

wherein the spool and fluid barrier are actuable to be axially moved in the bore to control axial flow paths along the bore between the plurality of radial ports; and wherein the connection apparatus is configured as a sampling hot stab apparatus on a remotely operated vehicle (ROV).

16. The system according to claim 15, wherein the fluid barrier is an annular fluid barrier arranged to seal an annulus between the spool and the bore.

17. The system according to claim 15, wherein the apparatus comprises at least three radial ports.

18. The system according to claim 17, wherein the spool and fluid barrier are actuable to be axially moved from a first position in which a flow path between a first port and a second port is open, and a second position in which a flow path between the second port and a third port is open.

19. The system according to claim 18, wherein in the first position, a flow path from the third port to the first or second ports is closed.

20. The system according to claim 18, wherein in the second position, a flow path from the first port to the second or third ports is closed.

21. A method of collecting a sample of fluid from a hydrocarbon production system, comprising:

providing a subsea production fluid sample collection system, the system comprising:

a subsea hydraulic circuit having a subsea hydraulic circuit receptacle; and a connection apparatus for a subsea hydraulic circuit;

wherein the connection apparatus comprises a longitudinal body configured to be removably docked with the subsea hydraulic circuit receptacle, the longitudinal body comprising a plurality of radial ports axially displaced along the body;

wherein the body comprises an axial bore accommodating a spool having at least one fluid barrier; and wherein the spool and fluid barrier are actuable to be axially moved in the bore to control axial flow paths along the bore between the plurality of radial ports; and using the system to deliver a sample of fluid from the hydrocarbon production system to a sample collection vessel.

22. The method according to claim 21 comprising flushing the connection apparatus to remove fluid from the connection apparatus after the delivery of the sample to the sample collection vessel.

23. The method according to claim 21, wherein the connection apparatus is configured as a sampling hot stab apparatus, and the sampling hot stab apparatus is in fluid communication with the sample collection vessel, the method comprising:

locating the sampling hot stab apparatus in a receptacle of the hydrocarbon production system, the receptacle being in fluid communication with a production fluid in the hydrocarbon production system;

collecting production fluid in the sample collection vessel via the sampling hot stab apparatus; and flushing the sampling hot stab apparatus prior to removal of the sampling hot stab apparatus from the receptacle.

24. The method according to claim 23, comprising providing a hydraulic interface apparatus, coupling the hydraulic interface apparatus to the sample collection vessel, and controlling the decanting of a pre-charged fluid from the sample collection vessel using the hydraulic interface apparatus.

25. The method according to claim 24, wherein decanting the pre-charged fluid from the sample collection vessel comprises flushing the sampling hot stab apparatus.

26. The method according to claim 23, comprising providing a hydraulic interface apparatus, and flushing the sampling hot stab apparatus using a hydraulic fluid source coupled to the hydraulic interface apparatus.

27. The method according to claim 23 comprising providing a hydraulic interface apparatus, and controlling the flow of fluid through the sampling hot stab apparatus using the hydraulic interface apparatus.

28. The method according to claim 23 wherein the sampling hot stab apparatus is a hot stab apparatus on a remotely operated vehicle (ROV).

29. The method according to claim 23 comprising providing a hydraulic interface apparatus, and actuating movement of the spool and fluid barrier of the hot stab apparatus using the hydraulic interface apparatus.

30. The method according to claim 21, comprising providing a hydraulic interface apparatus, and coupling the hydraulic interface apparatus to the sample collection vessel.

31. The method according to claim 21, comprising decanting a pre-charged fluid from the sample collection vessel into the hydrocarbon production system.

32. The method according to claim 21, comprising providing a hydraulic interface apparatus, coupling the hydraulic interface apparatus to the sample collection vessel, and controlling the collection of production fluid into the sample collection vessel using the hydraulic interface apparatus.

* * * * *